US006016813A

United States Patent [19]

Kennedy

[11] Patent Number: 6,016,813

[45] Date of Patent: Jan. 25, 2000

[54] BEAD LOCK AND METHOD OF RETAINING BEADS

[75] Inventor: Kathy Kennedy, Rancho Santa Margarita, Calif.

[73] Assignee: Beadwear, Inc., Rancho Santa Margarita, Calif.

[21] Appl. No.: 09/148,212

[22] Filed: Sep. 4, 1998

[51] Int. Cl.[7] ..... A45D 24/00

[52] U.S. Cl. ..... 132/200; 132/275

[58] Field of Search ..... 132/200, 275, 132/273, 212; 223/48; 24/136 L, 136 R, 115 M, 115 N; D28/41, 39

[56] References Cited

U.S. PATENT DOCUMENTS

| | | | |
|---|---|---|---|
| 2,567,408 | 9/1951 | Soderberg . | |
| 3,766,610 | 10/1973 | Thorsbakken | 24/136 R |
| 4,315,362 | 2/1982 | Pigford et al. . | |
| 4,455,717 | 6/1984 | Gray | 24/115 M |
| 4,458,389 | 7/1984 | Guthmann | 24/115 M |
| 4,622,723 | 11/1986 | Krauss . | |
| 4,675,948 | 6/1987 | Bengtsson . | |
| 4,771,516 | 9/1988 | Foth . | |
| 4,782,560 | 11/1988 | Keller . | |
| 5,197,166 | 3/1993 | Meier et al. . | |
| 5,224,245 | 7/1993 | Matoba . | |
| 5,323,514 | 6/1994 | Masuda et al. . | |
| 5,345,657 | 9/1994 | Shimizu . | |
| 5,365,954 | 11/1994 | Rude . | |
| 5,388,598 | 2/1995 | Whitten | 132/200 |
| 5,417,230 | 5/1995 | Wood . | |
| 5,444,897 | 8/1995 | Gross . | |
| 5,456,271 | 10/1995 | Legette . | |
| 5,511,567 | 4/1996 | Cefis . | |
| 5,558,105 | 9/1996 | Rosenwinkel, et al. | 132/200 |
| 5,573,017 | 11/1996 | Post . | |
| 5,573,018 | 11/1996 | Johnson . | |
| 5,582,447 | 12/1996 | Leon, et al. | 24/115 M |
| 5,590,670 | 1/1997 | Allred . | |
| 5,621,952 | 4/1997 | Frano . | |
| 5,657,513 | 8/1997 | Takahashi . | |
| 5,664,707 | 9/1997 | Spector . | |
| 5,666,699 | 9/1997 | Takahashi . | |
| 5,671,505 | 9/1997 | Anscher . | |
| 5,671,509 | 9/1997 | Yeung . | |
| 5,697,128 | 12/1997 | Peregrine . | |
| 5,737,808 | 4/1998 | Ikeda . | |
| 5,810,022 | 9/1998 | Reynolds . | |

FOREIGN PATENT DOCUMENTS 64309 of 0000 Austria .

OTHER PUBLICATIONS

A product brochure in one page for Beadmagic products by Beadwear, Inc. illustrating a bead stop referred to therein as product No. F4, and describing a method of placing the bead stop in the final bead of a series of beads placed on hair; circa Oct. 1996.

*Primary Examiner*—Todd E. Manahan
*Assistant Examiner*—Eduardo C. Robert
*Attorney, Agent, or Firm*—R. Scott Weide

[57] ABSTRACT

A bead lock and method of retaining beads on bead stringing material such as hair are disclosed. In one or more embodiments, the bead lock comprises a body that is adapted to fit within the passages through at least two adjacent beads. In accordance with a method of the present invention, bead stringing material is extended through the passages through the beads. The bead lock is then positioned in the passages though the two beads closest to the free end of the bead stringing material. The bead lock engages these beads and the bead stringing material, locking the beads in place on the bead stringing material.

23 Claims, 7 Drawing Sheets

BEAD LOCK AND METHOD OF RETAINING BEADS

BACKGROUND OF THE INVENTION

1. Field of the Invention

The present invention relates to beading, and more particularly, to a device and method for retaining one or more beads on bead stringing material such as hair.

2. Background

It is a common and popular practice to use beads to ornament hair. This practice is usually performed by threading beads onto the hair manually or by putting foil around the hair and stringing beads over the foil. Another method of placing beads on hair is to thread beads over a needle with a loop of string attached, pass the beads over the string, and then thread a band of hair through the loop. The beads are then backed over the loop and onto the band of hair.

A problem associated with beading is retaining the beads on the hair once they are placed on the hair. A rubber band may be wrapped around the hair or a small hair clip may be placed on the hair between the beads and the free end of the hair for this purpose. These methods of retaining the beads on the hair generally either detract from the beauty of the beads, are difficult to use, or are ineffective in securely retaining the beads on the hair over time. Another significant problem with many of these methods is that the wearer's hair is damaged by their use.

There is desired an improved device and method for retaining beads on hair and other bead stringing materials.

SUMMARY OF THE INVENTION

The present invention is a bead lock and a method of retaining beads on bead stringing materials such as cord, cloth, string and hair with the bead lock.

Various forms of a bead lock are disclosed. The bead lock is used with beads having a central hole or passage used to thread the bead onto bead stringing materials, including strands of hair.

In general, the bead lock comprises a body having first and second ends. In one or more embodiments, the distance between the ends of the body is greater than the distance through the passage of one bead, but not greater than the distance through the passages of two adjacent beads. The body is adapted to fit within the passages through the beads. In a resting or uninserted state, the body may have a transverse dimension which is larger than the corresponding dimension of the passage, but be flexible enough to deform into a shape that fits within the passage such that the body is biased against an inside wall defining the passage through the bead.

In accordance with the method of the invention, bead stringing material is extended through the passages through the beads until the desired number of beads have been threaded onto the bead stringing material. The bead lock is then inserted into the passages though the two beads closest to the free end of the bead stringing material. The bead lock engages the beads and the bead stringing material, locking the beads into place on the bead stringing material.

Further objects, features, and advantages of the present invention over the prior art will become apparent from the detailed description of the invention which follows, when considered with the attached figures.

DETAILED DESCRIPTION OF THE INVENTION

In general, the present invention comprises a bead lock and a method of retaining beads on bead stringing material, including hair, with the bead lock. In the following description, numerous specific details are set forth to provide a thorough description of the invention. It will be apparent, however, to one skilled in the art that the invention may be practiced without these specific details. In other instances, well-known features have not been described in detail so as not to obscure the invention. Further, although embodiments are described in which the bead stringing material is hair, it will be apparent that the invention may be used with other bead stringing materials, including, without limitation, cloth, string, cord and wire.

Figure 1:
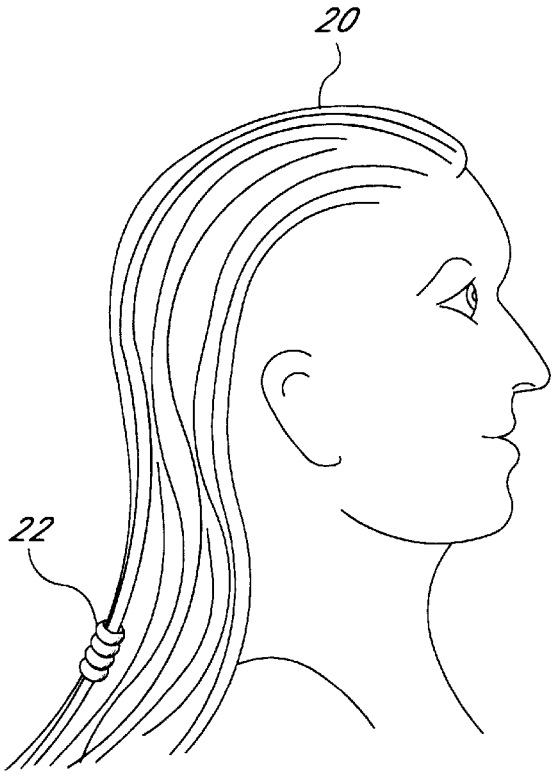
FIG. 1 illustrates multiple beads positioned on strands of hair of a person.

Referring now to the drawings, FIG. 1 illustrates a person having one or more strands of hair 20. Several beads 22 are positioned on the hair 20. While FIG. 1 illustrates four beads 22 on the hair, any desired number of beads 22 may be used. Referring to FIGS. 3–22, a bead lock 24 is provided for retaining these beads 22 on the hair 20.

While the bead lock 24 and method of the present invention are useful in retaining beads 22 on one or more strands of hair 20, those of skill in the art will appreciate that the invention may be used to place and retain beads on other bead stringing material, including cloth, string, cord or other similar materials.

Figure 4:
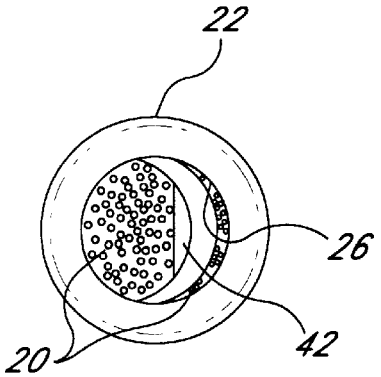
FIG. 4 is a top plan view of the bead lock engaging the hair and the beads illustrated in FIG. 3.

The beads 22 may be of a variety of shapes and sizes and be constructed from a variety of materials. Referring to FIG. 4, each bead 22 preferably has the common feature of a passage 26 extending therethrough. In the case where the beads 22 are generally spherical, it is common for the passage to extend along a diameter through the bead. In the case where the beads 22 are generally cylindrical, the passage typically extends along a longitudinal axis.

The beads 22 may be placed on the hair 20 or other bead stringing materials in a variety of mainers. For example, the beads 22 may be positioned on the hair using the tool and method disclosed and claimed in U.S. Pat. No. 5,687,751, issued Nov. 18, 1997.

The bead lock 24 in accordance with a first embodiment of the present invention will be described with reference to FIGS. 3–6. As illustrated therein, the bead lock 24 comprises a body 28. The body 28 is adapted to fit entirely within the passages 26 through two adjacent beads 22.

Figure 5:
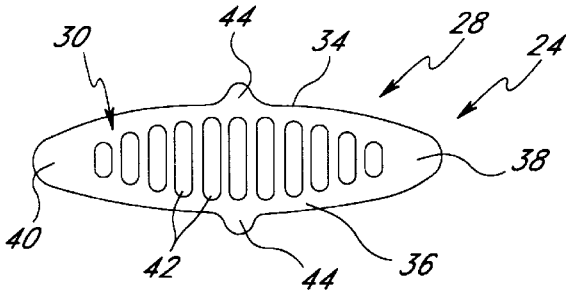
FIG. 5 is a front view of the bead lock illustrated in accordance with the first embodiment of the invention.
Figure 6:
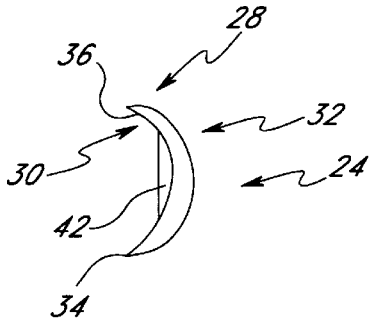
FIG. 6 is a top view of the bead lock illustrated in FIG. 5.

Referring to FIGS. 5 and 6, the body 28 of the bead lock 24 in accordance with the first embodiment has a pair of opposing surfaces or faces 30 and 32. The surfaces 30 and 32 have a pair of opposing sides or edges 34 and 36 and a first end 38 and a second end 40. In this embodiment, the body 28 is generally elongate, having a length from end to end which is greater than its maximum width between its sides 34 and 36.

The body 28 is not planar. Instead, the sides 34 and 36 curve inwardly towards one another as illustrated in FIG. 6 (i.e. the body 28 is curved about an axis extending through the body from end 38 to end 40). So arranged, one of the surfaces 30 is an "inside" or concave surface, while the other surface 32 is an "outside" or convex surface.

Several ribs 42 project outwardly from the inside surface 30. The ribs 42 are raised areas which extend transversely across the body 28 from near one side 34 to near the other side 36. The ribs 42 are spaced from one another.

A finger 44 extends outwardly from each side 34 and 36 between the first and second ends 38 and 40. Each finger 44 comprises a rounded projection.

In one or more embodiments, the body 28 is constructed of a durable and resilient material having some surface adhesion, such as PVC, other plastics or rubber. When constructed of these materials, the body 28 may be molded. The body 28 may also be constructed of a durable and resilient material which is smooth and has little surface adhesion, such as a relatively flexible metal member. In that case, the surface of body 28 may be coated or treated to provide some surface adhesion.

A method of retaining beads 22 on hair 20 in accordance with the present invention is as follows.

Figure 2:
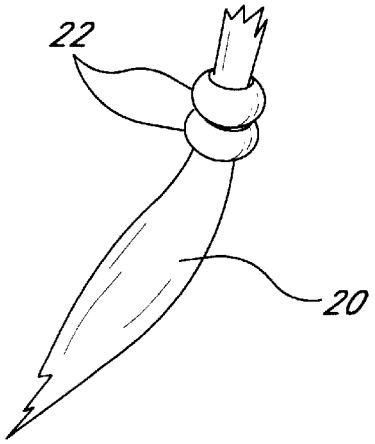
FIG. 2 is an enlarged view of two beads positioned on strands of hair.

First, the beads 22 are placed on the hair 20 as illustrated in FIGS. 1 and 2. The user presses the bead lock 24 into the passages 26 through the two beads 22 closest to the free end of the hair 20 such that the bead lock 24 is disposed between the hair 20 and the passage walls.

Figure 3:
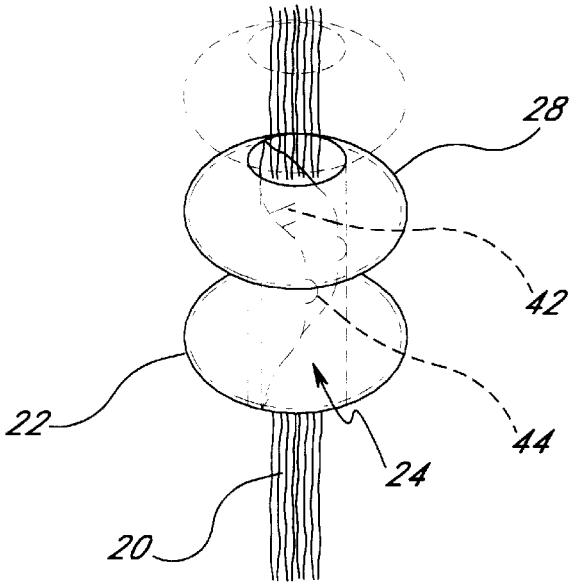
FIG. 3 is an elevational view of beads retained on hair utilizing a bead lock in accordance with a first embodiment of the present invention.

So positioned, the bead lock 24 is secured in the passages 26 through the beads 22. Once inserted, various of the surfaces of the bead lock 24 engage the passage 26 walls and the hair 20 passing through the beads 22. Referring to FIGS. 3 and 4, the outside surface 32 of the body 24 is pressed against portions of the wall defining the passages 26. For example, the outer edges 34 and 36 of the body 24, including the fingers 44, engage the inside passage walls of each bead 22. Other portions of the outer surface of the body engage the hair 20. Adhesive or high-friction characteristics of the exterior surface of the bead lock 24 may further insure that the bead lock 24 is securely retained to the hair 20 and beads 22.

The hair 20 is compressed in that portion of the passage 26 between the bead lock 24 and the bead 22. The ribs 42 on the bead lock 24 aid in gripping the hair 20 and maintaining the beads 22 on the hair 20.

Once placed in passages 26 through the two beads 22 closest to the free end of the hair 20, the bead lock 24 secures these two beads 22 closest to the free end of the hair 20 directly to the hair. Other beads 22 which are positioned along the hair 20 above those two beads which the bead lock 24 engages are retained by those two beads 22 on the hair 20. These other beads are prevented from moving towards the free end of the hair 20 by the two bottom beads 22 which the bead lock 24 engages.

If the body 28 of the bead lock 24 is resilient, it may be placed into a passage 26 which is smaller than the distance between its edges 34 and 36. In this case, the body 28 compresses or folds to reduce its size, permitting it to fit within beads 22 having a variety of sized passages 26.

The bead lock 24 is removed by extracting it from the passage 26 through each bead 22. This may be accomplished by sliding one of the two engaged beads 22 upwardly or downwardly off of the bead lock 24. A portion of the bead lock 24 is then readily accessible and can be pulled from the remaining bead 22.

As illustrated in FIG. 3, the bead lock 24 in accordance with the one or more embodiments of the invention has a length which is greater than the distance through the passage 26 of a single bead 22 and less than the distance through the passages 26 through two adjacent beads 22. In one or more embodiments, the length of bead lock 24 is approximately equal to the distance through the passages through two adjacent beads 22. Advantageously, the bead lock 24 having such a length is not visible because it is housed generally entirely within the two adjacent beads 22. The bead lock 24 thus does not detract from the appearance of the beads 22 or the hair 20.

Those of skill in the art will appreciate that the bead lock 24 of the invention may be have a greater or lesser length so as to cooperate with a single bead 22 or more than two beads 22. When the bead lock 24 is adapted to cooperate and engage at least two beads 22, better locking is achieved in one or more embodiments by having a greater surface area of the bead lock 24 contact the hair 20 and beads 22. When the bead lock 22 cooperates with no more than two beads 22, an advantage is realized in that the other beads 22 along the hair 20 are permitted to move independently and are not locked together in a rigid line.

Figure 7:
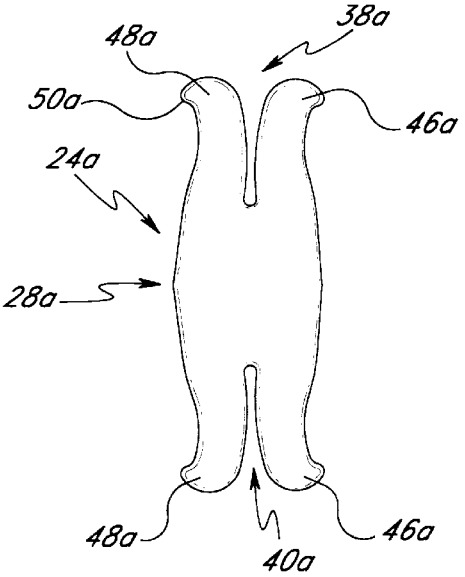
FIG. 7 is an elevational view of a bead lock in accordance with a second embodiment of the present invention.
Figure 8:
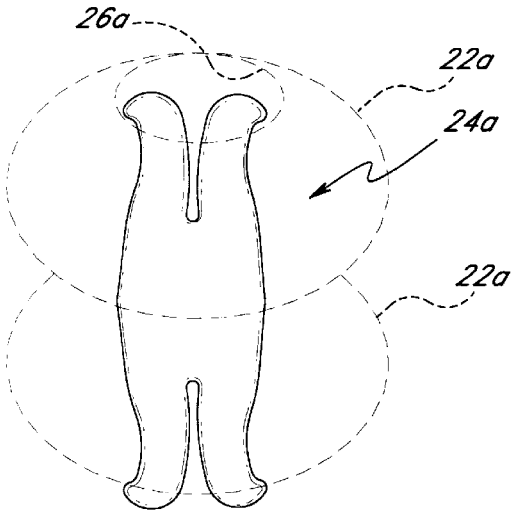
FIG. 8 illustrates the bead lock of the second embodiment of the invention engaging a pair of beads.

A bead lock 24*a* in accordance with a second embodiment of the present invention is illustrated in FIGS. 7 and 8. In the illustrations and description of this embodiment of the invention, like reference numerals have been used to designate like or similar parts to those of the previously described embodiment, except that an "a" designator has been added to all of the reference numerals of this embodiment.

The bead lock 24*a* comprises a generally planar body 28*a* having a first end 38*a* and a second end 40*a*. At its ends 38*a* and 40*a*, the body 28*a* is bifurcated, defining two legs 46*a* and 48*a*. The legs 46*a* and 48*a* are spaced slightly from one another, and each has a tip 50*a* which faces outwardly from the main portion of the body. In one or more embodiments, the tips 50*a* of adjacent legs 46*a* and 48*a* are spaced by a distance greater than the width of the passages 26*a* through the beads 22*a* into which the body 28*a* is placed.

The bead lock 24*a* may be constructed of materials similar to those described for the bead lock 24 illustrated in FIGS. 5 and 6 described above, and may be similarly sized. The bead lock 24*a* may be inserted into a pair of beads 22*a* in a manner similar to bead lock 24 described above.

When inserted in a passage 26*a* of a bead 22*a*, the legs 46*a* and 48*a* are in one or more embodiments are compressed towards one another, with the tips 50*a* thereof pressed or biased outwardly against the wall defining the passage 26*a* through the bead 22*a*. The body 28*a* occupies some of the space within the passage 26*a*, pressing the hair 20*a* between the body 28*a* and the bead 22*a*, locking the bead 22*a* to the hair 20*a*.

Figure 9:
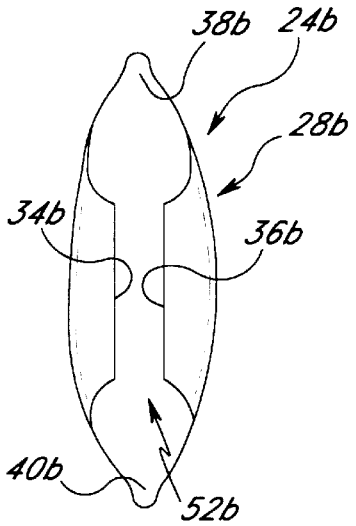
FIG. 9 is an elevational view of a bead lock in accordance with a third embodiment of the present invention.
Figure 10:
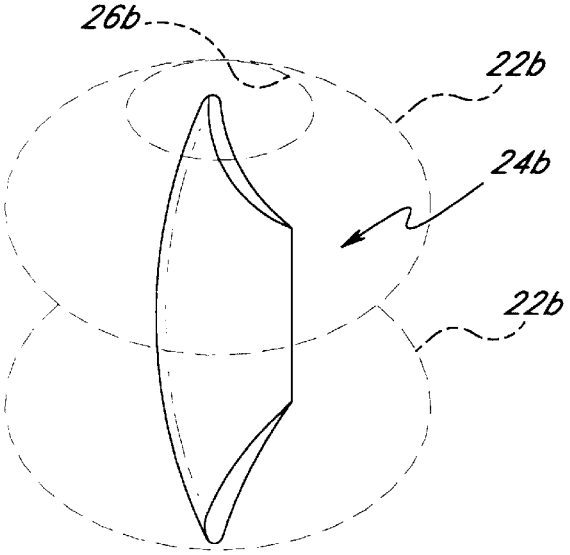
FIG. 10 illustrates the bead lock of the third embodiment of the invention engaging a pair of beads.

A bead lock 24*b* in accordance with a third embodiment of the present invention is illustrated in FIGS. 9 and 10. In the illustrations and description of this embodiment of the invention, like reference numerals have been used to designate like or similar parts to those of the previously described embodiments, except that a "b" designator has been added to all of the reference numerals of this embodiment.

The bead lock 24*b* in accordance with this embodiment is similar to that of the first embodiment illustrated in FIGS. 5 and 6. In this embodiment, a body 28*b* of the bead lock 24*b* is curved to the point where the opposing edges 34*b* and 36*b* nearly meet, thus forming a partially enclosed channel 52*b*, and whereby the body 28*b* is somewhat tubular in shape. The edges 34*b* and 36*b* are spaced by a distance which permits compression of the body 28*b* when the body 28*b* is placed in a passage 26*b*.

A method of retaining a bead 22*b* on hair 20*b* with the bead lock 24*b* is similar to that used for bead lock 24. The bead lock 24*b* of this embodiment, however, when inserted into passages 26*b* may trap hair 20*b* within its tubular body 28*b* in addition to trapping the hair between its body and the bead passage walls.

Figure 11:
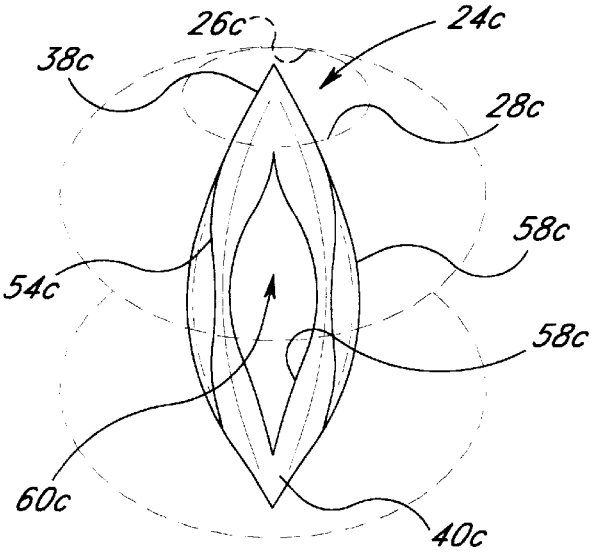
FIG. 11 is an elevational view of a bead lock in accordance with a fourth embodiment of the present invention.
Figure 12:
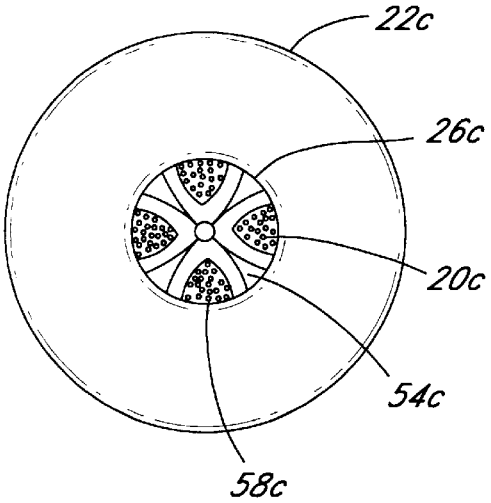
FIG. 12 illustrates the bead lock of the fourth embodiment of the invention engaging a pair of beads.

A bead lock 24*c* in accordance with a fourth embodiment of the present invention is illustrated in FIGS. 11 and 12. In the illustrations and description of this embodiment of the invention, like reference numerals have been used to designate like or similar parts to those of the previously described embodiments, except that a "c" designator has been added to all of the reference numerals of this embodiment.

The bead lock 24*c* in accordance with this embodiment comprises a generally hollow body 28*c* having first and second ends 38*c* and 40*c*. Four spaced, flexible wall elements 54*c* extend between the first and second ends 38*c* and 40*c*.

Each pair of adjacent wall elements 54*c* define a passage 58*c* leading to a hollow interior 60*c* of the body 28*c*. As illustrated in FIGS. 11 and 12, the body 28*c* includes four wall elements 54*c* that define four passages 58*c*. Referring to FIG. 12, these passages 58*c* appear as elongate grooves in the body 28*c* when viewed along the centerline of the body 28*c* from the first end 38*c* to the second end 40*c*.

In the embodiment illustrated in FIGS. 11 and 12, the wall elements 54*c* are curved, each having a first end at the first end 38*c* of the body 28*c* and a second end at the second end 40*c* of the body 28*c*. In-between the ends of the body 28*c*, each wall element 54*c* bows outwardly from a centerline extending through the body 28*c* from end 38*c* to end 40*c*.

A method of retaining beads 22*c* on hair 20*c* with the bead lock 24*c* is similar to that used for bead lock 24. As illustrated in FIG. 12, when the bead lock 24*c* is inserted into the beads 22*c*, it compresses inwardly and fits tightly within the passages 26*c* through the beads 22*c*. Hair 20*c* is trapped in the passages 58*c*, retaining the beads 22*c* on the hair.

Figure 13:
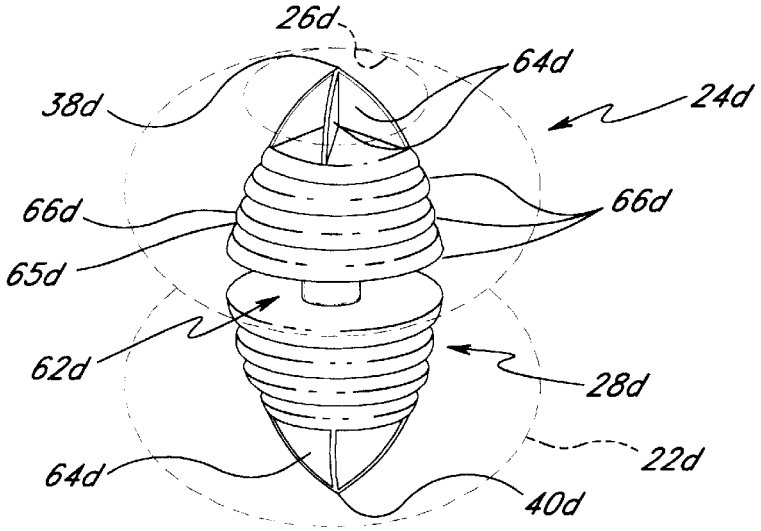
FIG. 13 is an elevational view of a bead lock in accordance with a fifth embodiment of the present invention.

A bead lock 24*d* in accordance with a fifth embodiment of the present invention is illustrated in FIG. 13. In the illustration and description of this embodiment of the invention, like reference numerals have been used to designate like or similar parts, to those of the previously described embodiments, except that a "d" designator has been added to all of the reference numerals of this embodiment.

The bead lock 24*d* in accordance with this embodiment comprises a body 28*d* having a first end 38*d* and a second end 40*d*. The body 28*d* generally has the shape of a football, having a diameter or radial dimension at its ends 38*d* and 40*d* which is less than its diameter or radial dimension away from and between its ends.

A groove 62*d* is positioned in the body 28*d* approximately mid-way between its ends 38*d* and 40*d*. The groove 62*d* extends inwardly from the outer surface of the body 28*d* around its entire circumference.

Ridges 66*d* and valleys 65*d* are provided in the outer surface of the body 28*d* between each of the ends 38*d* and 40*d* and the groove 62*d*. These ridges 66*d* are defined by alternating radially inwardly and outwardly extending portions of the body 28*d*. In one embodiment, the depth of the valleys 65d between the ridges 66*d* is much less than the depth of the groove 62*d*.

In one or more embodiments, each end 38*d* and 40*d* of the body 28*d* is defined by the convergence of four thin walls 64*d*.

A method of retaining beads 22*d* on hair with the bead lock 24*d* is similar to that used for bead lock 24. When the bead lock 24*d* is inserted into the passages 26*d* through the beads 22*d*, it compresses inwardly and fits tightly within the passages 26*d*. The compression of the body 28*d* is facilitated by the groove 62*d*, which provides a space into which the material comprising the body 28*d* may deform.

Hair is trapped between the outer surface of the bead lock 24*d* and the passage walls of the beads 22*d*, retaining the beads 22*d* on the hair.

Figure 14:
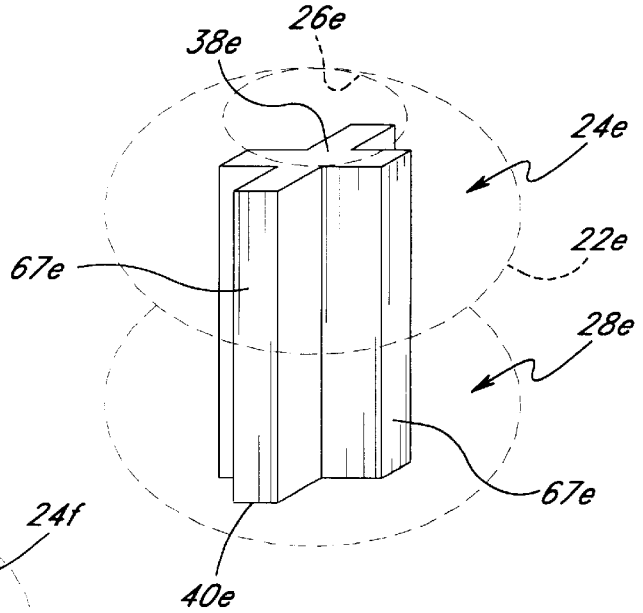
FIG. 14 is an elevational view of a bead lock in accordance with a sixth embodiment of the present invention.

A bead lock 24*e* in accordance with a sixth embodiment of the present invention is illustrated in FIG. 14. In the illustration and description of this embodiment of the invention, like reference numerals have been used to designate like or similar parts to those of the previously described embodiments, except that an "e" designator has been added to all of the reference numerals of this embodiment.

The bead lock 24*e* comprises a body 28*e* which has a first end 38*e* and a second end 40*e*. The body 28*e* has a cross or plus sign shape from end 38*e* to end 40*e*. So arranged, the body 28*e* is defined by a pair of intersecting rectangular columns 67*e*.

A method of retaining beads 22*e* on hair with the bead lock 24*e* is similar to that used for bead lock 24. When the bead lock 24*e* is inserted into the passages 26*e* through the beads 22*e*, it compresses inwardly and fits tightly within the passages 26*e*. Hair is trapped between the outer surface of the bead lock 24*e* and the inside passages walls of the beads 22*e*, retaining the beads 22*e* on the hair.

Figure 15:
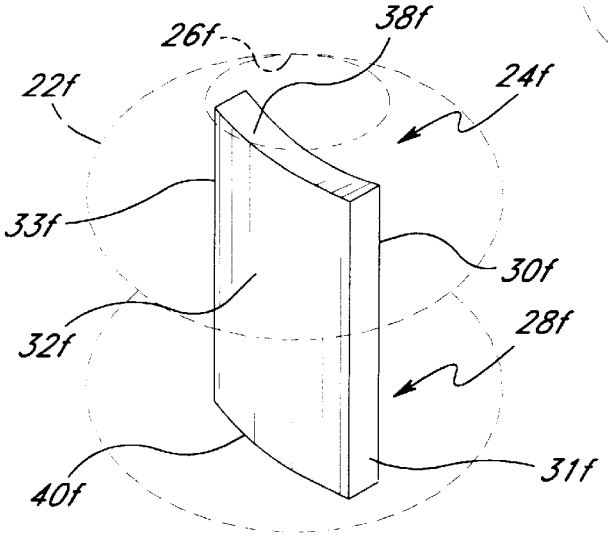
FIG. 15 is an elevational view of a bead lock in accordance with a seventh embodiment of the present invention.

A bead lock 24*f* in accordance with a seventh embodiment of the present invention is illustrated in FIG. 15. In the illustration and description of this embodiment of the invention, like reference numerals have been used to designate like or similar parts to those of the previously described embodiments, except that an "f" designator has been added to all of the reference numerals of this embodiment.

The bead lock 24*f* has a body 28*f* which is generally rectangular in shape, having a first end 38*f* and a second end 40*f*. The body 28*f* has a pair of opposing faces or surfaces 30*f* and 32*f*. A pair of opposing elongate sides or edges 31*f* and 33*f* are provided between the surfaces 30*f* and 32*f*.

In one or more embodiments, the body 28*f* is constructed of a relatively resilient material. The body 28*f* is constructed so that it its edges are biased in the direction of one of the surfaces 30*f*, such that the body 28*f* has a convex surface 32*f* and a concave surface 30*f* (i.e. the body 28*f* is curved about an axis extending through its ends 38*f* and 40*f*). In one or more embodiments, the body 28*f* has a width between its edges 31*f* and 33*f* that is greater than the width of the passage through a bead into which bead lock 24*f* is to be inserted.

A method of retaining beads 22*f* on hair 20*f* with the bead lock 24*f* is similar to that used for bead lock 24. When the bead lock 24*f* is inserted into the passages 26*f* through the beads 22*f*, it bends in the direction of the concave surface 30*f*. As a result, hair is compressed between the opposing surface 32*f* and the adjacent surfaces of the inside passage walls of the beads 22*f*.

Figure 16:
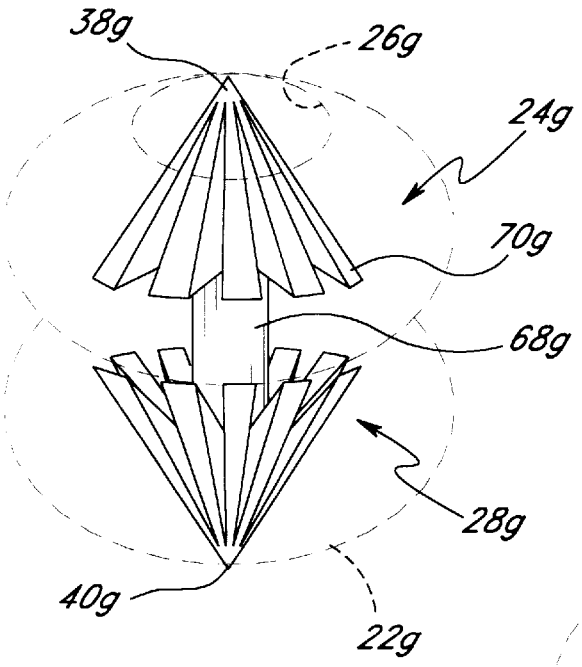
FIG. 16 is an elevational view of a bead lock in accordance with a eighth embodiment of the present invention.

A bead lock 24*g* in accordance with an eighth embodiment of the present invention is illustrated in FIG. 16. In the illustration and description of this embodiment of the invention, like reference numerals have been used to designate like or similar parts to those of the previously described embodiments, except that a "g" designator has been added to all of the reference numerals of this embodiment.

The bead lock 24*g* has, a body 28*g* having a first end 38*g* and a second end 40*g*. A central portion of the body 28*g* between its ends 38*g* and 40*g* comprises a shaft 68*g*.

At each of the first and second ends 38*g* and 40*g* barb elements 70*g* extend radially outwardly and in the direction of the opposite end. The elements 70*g* are spaced apart from one another and have a generally flat outer surface. The barb elements 70*g* form a generally cone-shaped tip at each end 38*g* and 40*g* of the body 24*g*.

A method of retaining beads 22*g* on hair with this bead lock 24*g* is similar to that used for the bead lock 24. When the bead lock 24*g* is inserted into the passages 26*g* of the beads 22*g*, hair extends between the barb elements 70*g*. The barb elements 70*g* compress radially inwardly towards the central shaft 68*g*, and also towards one another, closing the space between adjacent barb elements 70*g*. In this manner, the outer surface of the barb elements 70*g* grips the beads 22*g*, and the hair is tightly wedged between adjacent barb elements 70*g*.

Figure 17:
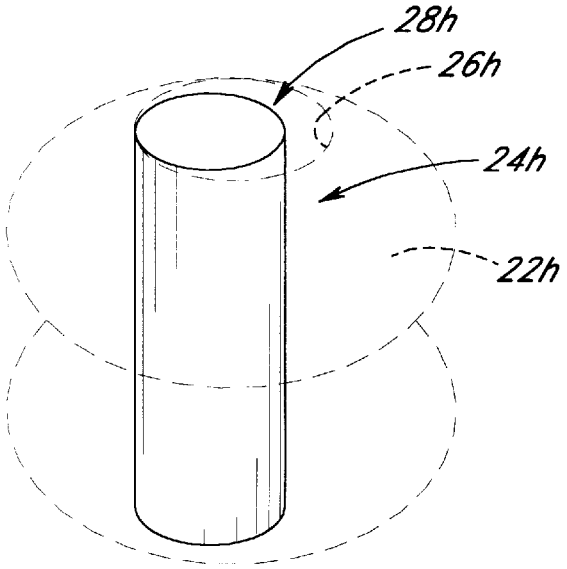
FIG. 17 is an elevational view of a bead lock in accordance with a ninth embodiment of the present invention.

A bead lock 24*h* in accordance with a ninth embodiment of the present invention is illustrated in FIG. 17. In the illustration and description of this embodiment of the invention, like reference numerals have been used to designate like or similar parts to those of the previously described embodiments, except that an "h" designator has been added to all of the reference numerals of this embodiment.

The bead lock 24*h* in accordance with this embodiment comprises a body 28*h* which is right-circular cylinder-shaped. In one or more embodiments, the length of the body 28*h* is approximately equal to the distance through the passages 26*h* through two adjacent beads 22*h*. In one or more embodiments, the diameter of the body 28*h* is preferably slightly less than the diameter of a passage 26*h* through a bead 22*h*.

A method of using bead lock 24*h* to retain beads 22*h* on hair is similar to that used for bead lock 24. When the bead lock 24*h* is inserted into the passages 26*h* of the beads 22*h*, the hair is forced into the remaining space in the passages 36*h* not occupied by the bead lock 24*h*. In this manner, the bead lock 24*h* is compressed against the inside passage walls of the beads 22*h* and the hair is compressed between the bead lock 24 and the inside passage walls of the beads.

Figure 18:
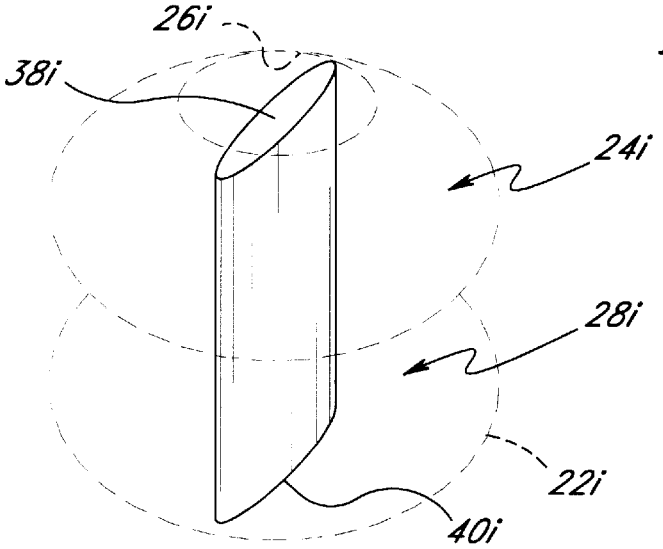
FIG. 18 is an elevational view of a bead lock in accordance with a tenth embodiment of the present invention.

A bead lock 24*i* in accordance with a tenth embodiment of the present invention is illustrated in FIG. 18. In the illustration and description of this embodiment of the invention, like reference numerals have been used to designate like or similar parts to those of the previously described embodiments, except that an "i" designator has been added to all of the reference numerals of this embodiment.

The bead lock 24*i* in accordance with this embodiment comprises a body 28*i* which has the form of an oval cylinder (i.e. a cylinder having an oval cross-section when the cross-section is taken perpendicular to a surface of the outer wall).

A method of using the bead lock 24*i* to retain beads on hair is similar to that used for bead lock 24. The bead lock 24*i* is inserted into the passages 26*i* through a pair of adjacent beads 22*i*, compressing the hair against the inside passage walls of the beads 22*i* and thereby binding the hair to the beads 22*i*.

Figure 19:
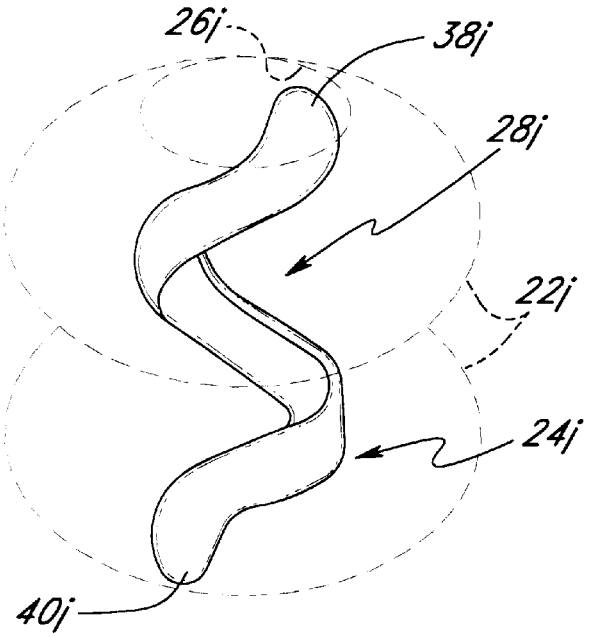
FIG. 19 is an elevational view of a bead lock in accordance with an eleventh embodiment of the present invention.

A bead lock 24*j* in accordance with an eleventh embodiment of the present invention is illustrated in FIG. 19. In the illustration and description of this embodiment of the invention, like reference numerals have been used to designate like or similar parts to those of the previously described embodiments, except that a "j" designator has been added to all of the reference numerals of this embodiment.

The bead lock 24*j* in accordance with this embodiment comprises a body 28*j* which is serpentine. The body 28*j* has a first end 38*j* and a second end 40*j*. Between its ends 38*j* and 40*j*, the body 28*j* comprises a band of material following a helical path. The body 28*j* defines a central passage between its ends 38*j* and 40*j*.

A method of using bead lock 24*j* to retain beads on hair is similar to that used for bead lock 24. In one or more embodiments, the hair passing through the beads 22*j* is bunched tightly and then inserted into the passage or central section of the bead lock 24*j* formed by the body 28*j*. The bead lock 24*j* is then pressed upwardly into the passages 26*j* of the beads 22*j*. The hair presses the bead lock 24*j* outwardly against the inside passage walls of the beads 22*j* thereby holding the beads 22*j* in place on the hair.

Figure 20:
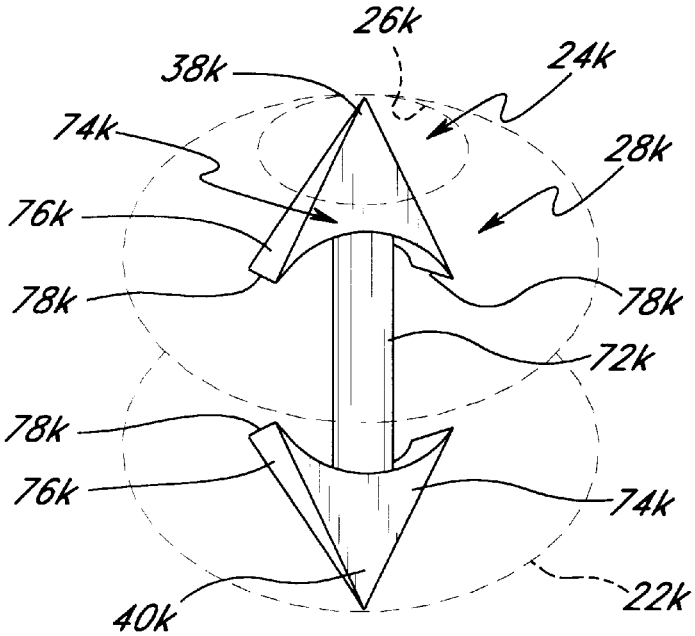
FIG. 20 is an elevational view of a bead lock in accordance with an twelfth embodiment of the present invention.

A bead lock 24*k* in accordance with a twelfth embodiment of the present invention is illustrated in FIG. 20. In the illustration and description of this embodiment of the invention, like reference numerals have been used to designate like or similar parts to those of the previously described embodiments, except that a "k" designator has been added to all of the reference numerals of this embodiment.

The bead lock 24*k* of this embodiment comprises a body 28*k* having a first end 38*k* and a second end 40*k*. Between its ends 38*k* and 40*k*, the body 28*k* comprises a rod element 72*k*. At each of its ends 38*k* and 40*k*, the body 28*k* comprises a triangular arrow-shaped element or tip 74*k*. In one or more embodiments, the tips 74*k* have a pair of flat outer surfaces 76*k* which widen from a thin or narrow point at the end 38*k* and 40*k* to a free end 78*k*.

A method of using bead lock 24*k* to retain beads on hair is similar to that used for bead lock 24. When the bead lock 24*k* is inserted into the passages 26*k* of the beads 22*k*, the free ends 78*k* of the tips 74*k* bend or flex inwardly towards the rod 72*k*. The flat outer surfaces 76*k* press against the inside walls of the passages 26*k*, securing the bead lock 24*k* to the bead. The hair is forced into the remaining space in the passages 26*k* not occupied by bead lock 24*k* and compressed between the passage walls of the bead 22*k* and the bead lock 24*k*.

Figure 21:
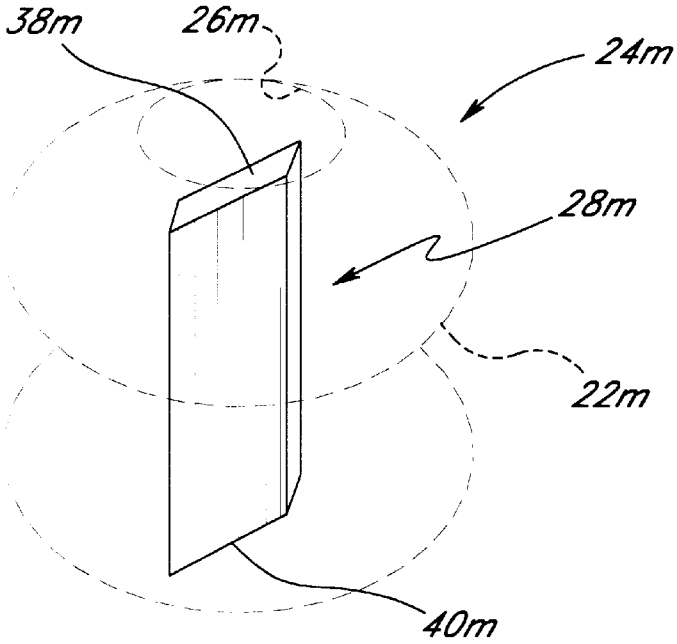
FIG. 21 is an elevational view of a bead lock in accordance with a thirteenth embodiment of the present invention.

A bead lock 24*m* in accordance with a thirteenth embodiment of the present invention is illustrated in FIG. 21. In the illustration and description of this embodiment of the invention, like reference numerals have been used to designate like or similar parts to those of the previously described embodiments, except than an "m" designator has been added to all of the reference numerals of this embodiment.

The bead lock 24*m* in accordance with this embodiment comprises body 28*m* generally having the shape of a non-rectangular parallelepiped.

A method of using bead lock 24*m* to retain beads on hair is similar to that used for bead lock 24*m*. When the bead lock 24*m* is inserted into the passages 26*m* of the beads 22*m*, the hair is forced into the remaining space in the passages 26*m* not occupied by the bead lock 24*m* and compressed between the inside passage walls of the beads 22*m* and the bead lock 24*m*.

Figure 22:
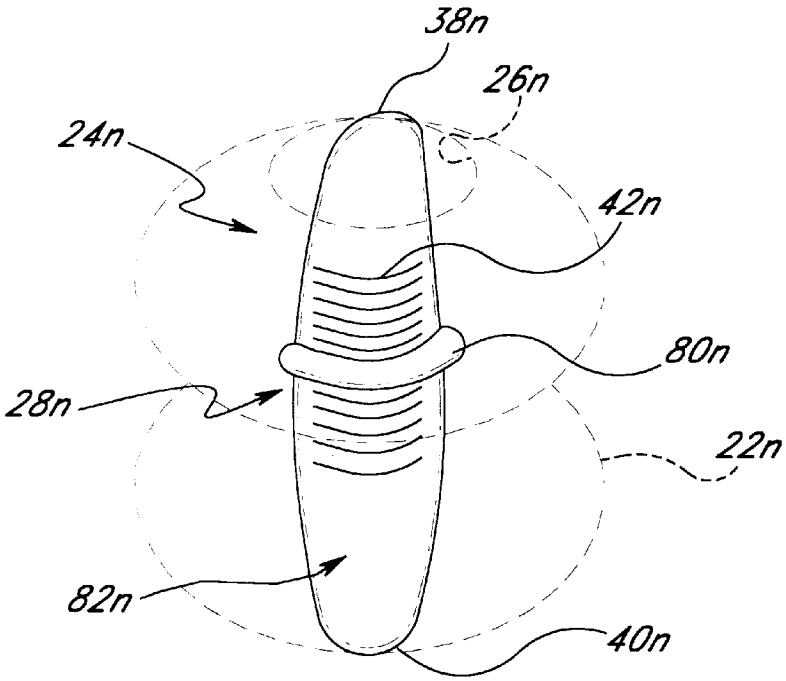
FIG. 22 is an elevational view of a bead lock in accordance with a fourteenth embodiment of the present invention.

A bead lock 24*n* in accordance with a fourteenth embodiment of the present invention is illustrated in FIG. 22. In the illustration and description of this embodiment of the invention, like reference numerals have been used to designate like or similar parts, to those of the previously described embodiments, except than an "n" designator has been added to all of the reference numerals of this embodiment.

The bead lock 24*n* has a body 28*n* which is similar in shape to that of the embodiment illustrated in FIG. 6. The body 28*n* has a concave surface and a convex surface and a first end 38*n* and a second end 40*n*. In FIG. 22, primarily only the convex surface 82*n* is visible.

In this embodiment ribs 42*n* are located on the convex or outer surface of the body 28*n* not on the concave inside surface as in the embodiment illustrated in FIG. 6. The concave surface of the body 28*n* is generally smooth.

In addition, a transverse tab 80*n* extends outwardly from the convex surface. In one or more embodiments, this tab 80*n* is located approximately mid-way between the ends 38*n* and 40*n* of the body 28*n*. The tab 80*n* extends along the convex surface from edge to edge.

A method of using bead lock 24*n* to retain beads 22*n* on hair is similar to that used for bead lock 24. When the bead lock 24*n* is inserted into the passages 26*n* through the beads 22*n*, the hair is forced into the space in the passages 26*n* between the inside passage walls of the beads 22*n* and the concave surface of the bead lock 24*n*. The ribs 42*n* on the body 28*n* of the bead lock 24*n* grip the inside passage surfaces of the beads, 22*n*. In one or more embodiments, the tab 80*n* is positioned between the two adjacent beads 22*n*, spacing them slightly.

The bead locks of present invention may be constructed by molding, extrusion, machining or other means known to those of skill in the art. A bead lock of the invention may comprise a single unitary element or more than one element. For example, the rod 72*k* and the tips 76*k* of the body 28*k* of the bead lock 24*k* illustrated in FIG. 20 may comprise separate elements. These separate elements may be corrected to form body 28*k*.

As stated above, in one or more embodiments, the body of the bead lock of the invention comprises a member that is somewhat resilient and that has a high degree of surface adhesion. The outer surface of the body may have a positive adhesive characteristic, such that it bonds to material it contacts, or it may be rough with a high coefficient of friction.

Where the body of the bead lock of the invention is constructed of more than one element or member, the members may comprise different materials. For example, with regard to the example given above, the rod 74*k* of the body 28*k* of the bead lock 24*k* illustrated in FIG. 20 may comprise a fairly rigid plastic, while the tips 76*k* may comprise a rubber material or the like.

The foregoing description is that of example embodiments of the invention. It will be understood that various changes and modifications may be made without departing from the spirit and scope of the invention, as defined by the claims.

What is claimed is:

1. A method of retaining at least two beads on bead stringing material having a free end, comprising the steps of:

obtaining a first bead and a second bead, said first and second beads each having a passage therethrough;

positioning said first and second beads on said bead stringing material, said bead stringing material passing through said passages through said first and second beads; and locking said first and second beads to said bead stringing material, said locking step comprising the step of compressing a bead lock in each passage through said first and second beads, whereby said first and second beads are retained on said bead stringing material by frictional engagement of said bead lock and bead stringing material with said first and second beads.

2. The method of claim 1 wherein said bead lock has a first end and a second end, and wherein said locking step comprises positioning said first end in said passage through said first bead and positioning said second end in said passage through said second bead.

3. The method of claim 1 further comprising the step of retaining a third bead on said bead stringing material, said step including the step of positioning said third bead on said bead stringing material prior to positioning said first and second beads on said bead stringing material.

4. The method of claim 1 wherein said locking step includes the step of compressing said bead stringing material between a surface of said bead lock and a surface of at least one of said first and second beads.

5. The method of claim 1 wherein said passage through said first and second beads is generally of a uniform diameter.

6. The method of claim 1 wherein said bead lock has first and second surfaces and said locking step includes the step of positioning at least a portion of said bead stringing material between said first and second surfaces of said bead lock.

7. The method of claim 1 wherein said step of positioning said bead in lock in said passages includes the step of deforming said bead lock from a first state in which a dimension of said bead lock is greater than a corresponding dimension of one of said passages, to a second state in which said dimension of said bead lock is less than said corresponding dimension of said passage.

8. The method of claim 7 wherein said bead lock has a body with a first end and a second end, said first and second ends defining a line passing through said body and said step of deforming comprises the step of compressing a portion of said bead lock towards said line.

9. The method of claim 1 wherein said bead stringing material comprises hair.

10. In combination, a first bead, a second bead, and a bead lock, said first bead and said second bead each having a passage through which a bead stringing material extends, said bead lock comprising a body compressed into at least a portion of a remaining space in each passage through said first and second beads not occupied by said bead stringing material, whereby said first and second beads are retained on said bead stringing material.

11. The combination of claim 10 wherein said body has a concave face and a convex face.

12. The combination of claim 11 comprising at least one rib that extends outwardly from at least one of said convex or concave faces.

13. The combination of claim 12 comprising a tab that extends outwardly from said convex face, said tab extending generally perpendicular to a line defined through said first and second ends of said body.

14. The combination of claim 10 wherein said first and second ends of said body are bifurcated.

15. The combination of claim 10 wherein said body is generally tubular.

16. The combination of claim 10 wherein said body has a cross-section generally in the shape of a cross.

17. The combination of claim 10 wherein said body has a generally rectangular cross-sectional shape.

18. The combination of claim 10 wherein said body has a first end and a second end and one or more spaced barb elements extend outwardly in the direction of said first end from said second end and one or more spaced barb elements extend outwardly in the direction of said second end from said first end.

19. The combination of claim 10 wherein said body is generally cylindrical in shape.

20. The combination of claim 10 wherein a cross-section of said body has a generally oval shape.

21. The combination of claim 10 wherein said body has a serpentine shape.

22. The combination of claim 10 wherein said body comprises a shaft having a generally pointed first end and a generally pointed second end.

23. The combination of claim 10 wherein said passage through said first bead has a first length and said passage through said second bead has a second length, said body of said bead lock has a first end and a second end and a length less than or equal to said first and second lengths combined.

* * * * *